US007459061B2

(12) United States Patent
Passiniemi

(10) Patent No.: US 7,459,061 B2
(45) Date of Patent: Dec. 2, 2008

(54) STEAM DISTRIBUTION APPARATUS WITH REMOVABLE COVER FOR INTERNAL ACCESS

(75) Inventor: Eric O. Passiniemi, Surrey (CA)

(73) Assignee: Honeywell International Inc., Morristown, NJ (US)

( * ) Notice: Subject to any disclaimer, the term of this patent is extended or adjusted under 35 U.S.C. 154(b) by 714 days.

(21) Appl. No.: 10/996,503

(22) Filed: Nov. 23, 2004

(65) Prior Publication Data

US 2006/0107704 A1 May 25, 2006

(51) Int. Cl.
*D21G 3/00* (2006.01)

(52) U.S. Cl. ..... 162/272; 34/114; 34/119; 34/130; 34/451

(58) Field of Classification Search ..... 162/272; 34/114, 119, 122, 124, 130, 451, 452
See application file for complete search history.

(56) References Cited

U.S. PATENT DOCUMENTS

| | | | | |
|---|---|---|---|---|
| 3,945,570 | A | 3/1976 | Dove | 239/135 |
| RE28,968 | E | 9/1976 | Dove | 137/608 |
| 4,268,976 | A | 5/1981 | Dove | 34/155 |
| 4,320,583 | A | 3/1982 | Dove | 34/54 |
| 4,351,700 | A | 9/1982 | Dove | 162/252 |
| 4,358,900 | A | 11/1982 | Dove | 34/54 |
| 4,398,355 | A | 8/1983 | Dove | 34/54 |
| 4,422,575 | A | 12/1983 | Dove | 239/562 |
| 4,444,622 | A | 4/1984 | Dove | 162/207 |
| 4,651,981 | A | 3/1987 | Passiniemi | 267/162 |
| 4,662,398 | A * | 5/1987 | Wywailowski et al. | 137/625.4 |
| 5,211,813 | A | 5/1993 | Sawley et al. | 162/207 |
| 5,798,026 | A | 8/1998 | Wacinski et al. | 162/290 |
| 6,408,534 | B1 * | 6/2002 | Alen et al. | 34/114 |

* cited by examiner

*Primary Examiner*—Mark Halpern
(74) *Attorney, Agent, or Firm*—Cascio Schmoyer & Zervas

(57) ABSTRACT

Employment of one or more resealable access slots in a steam distributor apparatus affords easy access to the internal chambers of the apparatus for cleaning and maintenance. The access slots can be located on the lower walls of the steam discharge chambers where debris tend to aggregate during operation of the apparatus. The apparatus can have multiple discharge chambers that are separated by spaced-apart partitions or baffle panels. Steam that is supplied from a steam header to each chamber exits each chamber through perforations of a discharge screen plate that is permanently secured onto adjacent partition panels. Actuators can regulate the steam flow from the steam header to the individual discharge chambers thereby creating a steam curtain with uniform or non-uniform cross direction profiles as desired.

15 Claims, 5 Drawing Sheets

STEAM DISTRIBUTION APPARATUS WITH REMOVABLE COVER FOR INTERNAL ACCESS

FIELD OF THE INVENTION

The present invention generally relates to a steam distributor for applying steam to a paper sheet moving along its side wherein one or more sealable slots located along the cross direction of the distributor permits easy access to the internal compartments or chambers for cleaning and maintenance.

BACKGROUND OF THE INVENTION

The steam heating of a paper sheet is widely practiced in papermaking. The increase in sheet temperature that results provides increased drainage rates for the water thus reducing the amount of water to be evaporated in the drier section. Water drainage is improved by the application of steam principally because the heating of the sheet reduces the viscosity of the water, thus increasing the ability of the water to flow. Most of the heat transfer takes place when the steam condenses in the sheet. The condensation of the steam transforms the latent heat of the steam to sensible heat in the water contained by the sheet.

A particular advantage of the steam heating of the paper sheet is that the amount of steam applied may be varied across the width of the sheet along the cross machine direction so that the cross machine moisture profile of the sheet may be modified. This is usually carried out to ensure that the moisture profile at the reel is uniform. Apparatus are well known in the papermaking art that can sense the moisture profile of a sheet of paper. If such an apparatus is positioned over the paper sheet, downstream of a steam distributor able to control the moisture profile, then after measuring the water profile in the sheet, steam can be applied in varying amounts on a selective basis across the sheet, thus achieving the required uniform moisture profile at the reel.

It is known to divide a steam distributor into compartments and to control the supply of steam to each compartment, thus controlling the moisture profile of the sheet. Unfortunately, with prior art designs, fiber and dirt tend to accumulate within the compartments and over time, the debris penetrates into the internal structures and interfere with steam flow. The steam distributor must be disassembled in order to clean the internal components; this requires that the entire screen covering the steam distributor be moved.

SUMMARY OF THE INVENTION

The present invention is based in part on the development of a steam distributor that preferably includes multiple steam discharge chambers or compartments that are separated by spaced-apart partitions or baffle panels. Steam exits each compartment through perforations in a perforated steam discharge screen plate that is permanently secured, e.g., welded, onto adjacent partition panels. The steam distributor also includes one or more resealable access slots or channels through which debris that is trapped within the internal of the compartments can be readily removed.

In one embodiment, the invention is directed to an apparatus to distribute steam to a moving sheet, the apparatus having a leading edge and a trailing edge relative to the moving sheet, the apparatus includes:

(a) a steam distribution header; and (b) a housing defining at least one steam discharge chamber that is covered with a perforated screen plate, wherein each discharge chamber is in fluid communication with the steam distribution header and the at least one steam discharge chamber has at least one sealable access slot.

In another embodiment, the invention is directed to an apparatus to distribute steam to a moving sheet, the apparatus having a leading edge and a trailing edge relative to the moving sheet, the apparatus includes:

(a) a steam distribution header;

(b) housing comprising a plurality of partition panels that are spaced apart along the length of the apparatus to form a plurality of steam discharge chambers that are covered with one or more perforated screen plates, wherein each discharge chamber is in fluid communication with the steam distribution header through a conduit that has an inlet in the steam distribution header and an outlet in a discharge chamber and wherein, each discharge chamber includes a lower wall that defines a sealable access slot; and (c) means for controlling the flow of steam from the steam distribution header to each discharge chamber.

Typically, each discharge chamber has an associated access slot that is located adjacent to the outer, lower portion of the discharge chamber where debris tends to congregate. The dimensions of each access slot are preferably relatively small as compared to that of the discharge chamber. Upon removal of a cleanout bar or other resealable implement that covers the access slot, the internal parts of the discharge chamber the can be cleaned of debris, dirt, and other contaminants with high pressure water that is delivered by a spray wand configured to fit through the slot. This reduces the likelihood of damage to the steam distribution apparatus since the fragile screen plates are not removed and handled. The perimeter of each access slot can be lined with a gasket to provide additional protection against steam leakage. And to facilitate precise alignment of a sealable cleanout bar over the access slot, the housing adjacent the access slot and the cleanout bar itself can have matching apertures for visual alignment. These matching apertures can accommodate dowel pins which help secure the cleanout bar to the steam distributor body.

Furthermore, since the discharge screen plates are permanently secured onto the partitions that separate the discharge chambers, the screen plates are an integral part of the body structure of the steam distributor. This design further prevents the thin screen plates from being twisted or otherwise damaged. Preferably, the screen plates are welded onto the partitions so that under certain abnormal operating conditions such as steam overpressure within the discharge chambers, screen plate damage is significantly reduced because of the integral design.

DETAILED DESCRIPTION OF PREFERRED EMBODIMENTS

Figures 1A, 1B, 1C:
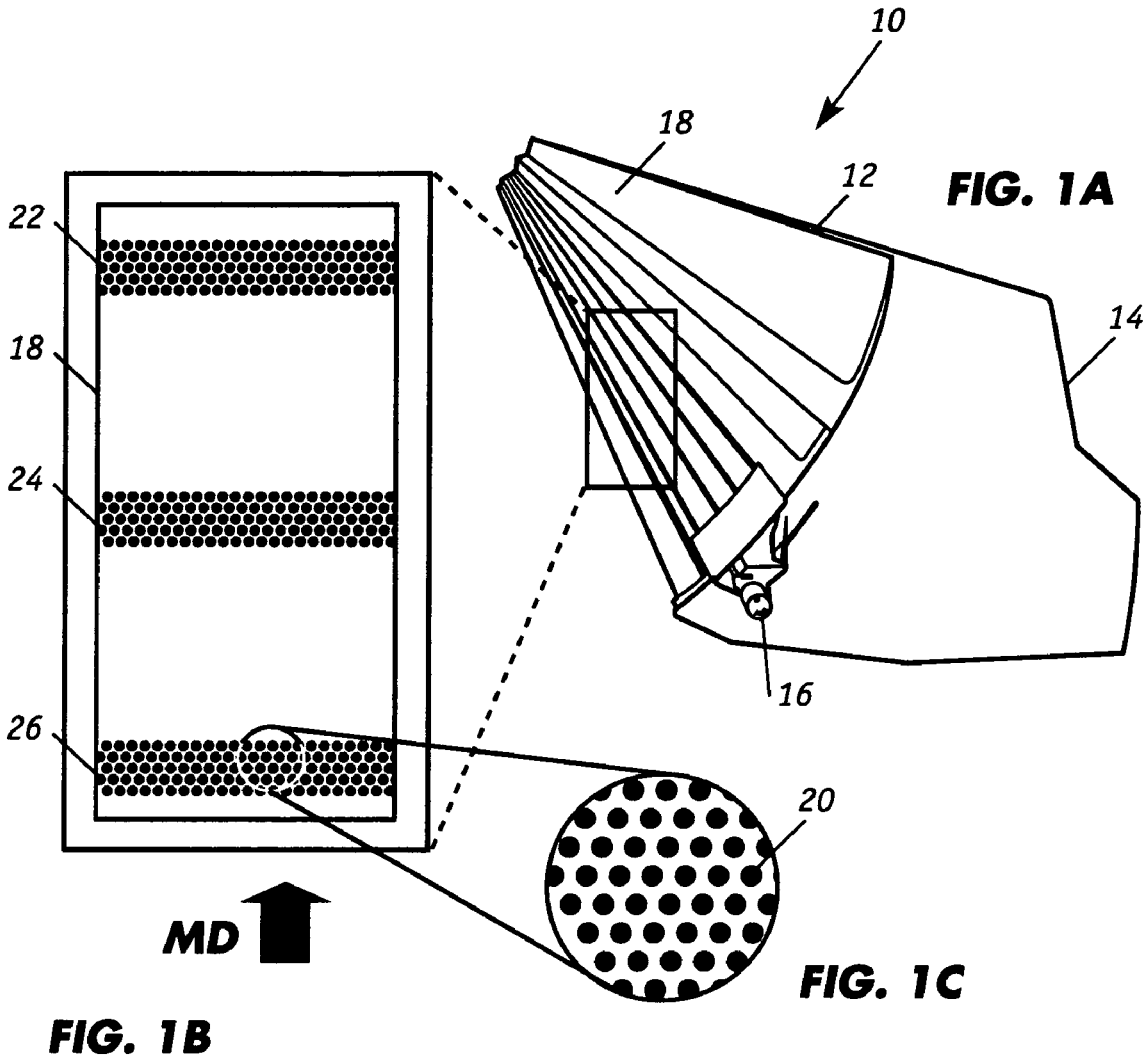
FIG. 1A is a perspective view of a steam distribution apparatus.
FIGS. 1B and 1C are enlarged views of the discharge screen plate in the steam distributor apparatus.

FIG. 1A illustrates the overall assembly of a steam distribution apparatus or steam shower 10 which includes an elongated housing 12 that is enclosed by end plates located at opposite ends. The length of the apparatus typically corresponds to the width of the sheet or web to which steam is to be applied. For papermaking operations the length can range, for instance, up to about 30 feet (9.1 meters). An external source of steam is connected to the steam distribution apparatus and excess steam in the form of condensate is removed through a drain 16 which is located on the side of end plate 14. The contour of the front screen panel or plate 18 preferably matches the external shape of the product to which steam is being supplied. The concave-shaped curvature of front screen panel 18 is particularly suited for apply steam to a roll of material. The front screen panel can also have a planar configuration to match the straight run of a moving sheet.

As further described herein, the steam distributor apparatus 10 is separated into a plurality of steam discharge chambers or compartments along the length of the apparatus 10 so that profiling of the steam application can be accomplished. For example, the amount of steam that enters into the individual chambers can be controlled in response variations in measured properties of the sheet along its cross direction.

FIGS. 1B and 1C show the arrangement of the steam outlets or perforations 20 that are formed across the entire length of the front screen panel 18. Typically, the outlets 20 are arranged in a plurality of rows 22, 24, and 26, for instance. The individual outlets 20 can be circular or have non-circular configurations. The number and size of the outlets are designed to achieve the desired steam flow rate and velocity. The size of the outlets 20 should be sufficiently small to minimize the amount of fibers and other debris from the sheet of material being heated that enters into the discharge chambers. Nevertheless, in operation, as steam is applied through the perforations 20 onto a moving sheet of paper, for stance, the front screen plate 18 can come into contact with the sheet. As a result, fiber and dirt will clog the perforations 20 and accumulate inside the housing 12 as well.

Figure 2:
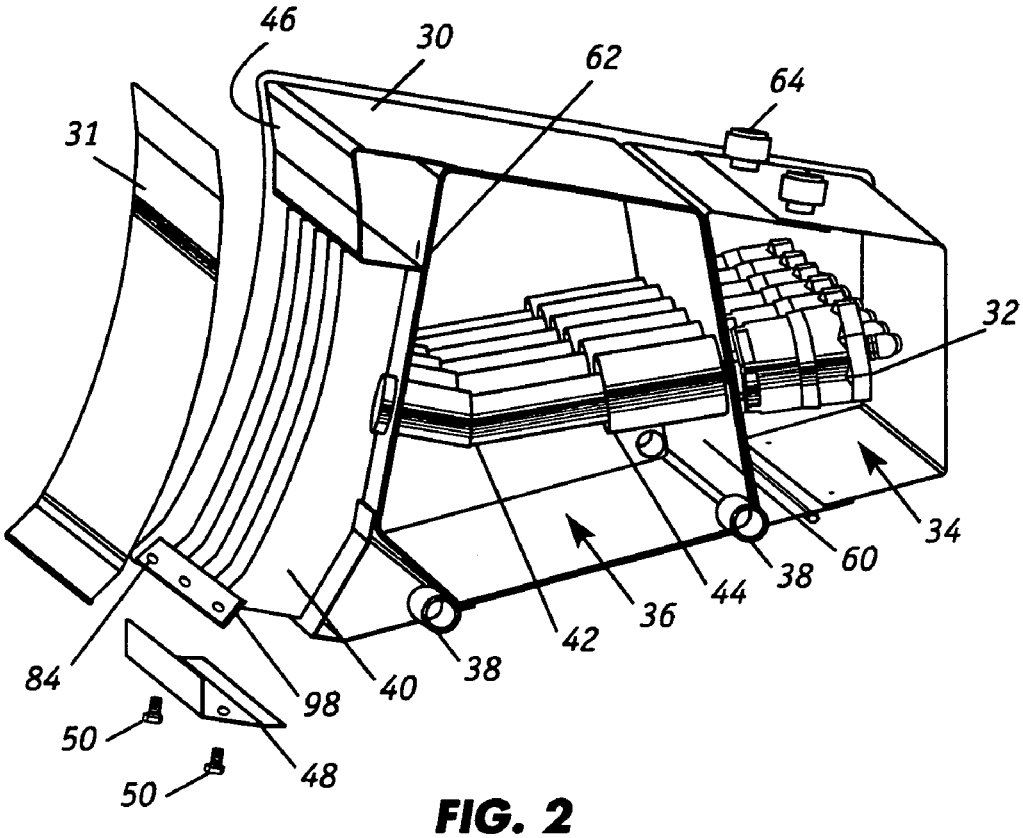
FIG. 2 is a perspective view of a compartment in the steam distributor apparatus.

FIG. 2 shows a partially disassembled exposed portion of the housing 30 of the steam distributor apparatus. The housing 30 encloses a steam distribution header 36 which is connected to at least one source of steam (not shown). Header 36 runs the length of the steam distribution apparatus. The header 36 is flanked by an interior wall 60 and an exterior wall 62. The inner enclosure 34 shields the pneumatic actuators 32 with a removable cover that is secured by the hand tightened screws 64. A plurality of baffles or partition panels 40, that are laterally spaced apart are secured to the exterior wall 62 thereby creating a number of steam discharge chambers or compartments once the front screen panel segment 31 is secured to the forward part of the housing.

Each pneumatic actuator 32 is operatively connected to a pipe 42 which has an inlet end located within the header 36 and an outlet end that is located in a discharge chamber. In this embodiment, the inlet end of the pipe 42 is partially covered by a sleeve 44. A piston is attached to the actuator 32 by a connecting rod to regulate the inlet into pipe 42 and thus control the steam flow between the header 36 and the control chamber. Pneumatic actuators for regulating steam flow in a steam distribution apparatus are described in U.S. Pat. No. 4,398,355 to Dove and U.S. Pat. No. 4,351,700 to Dove, which are incorporated herein by reference.

Figure 3:
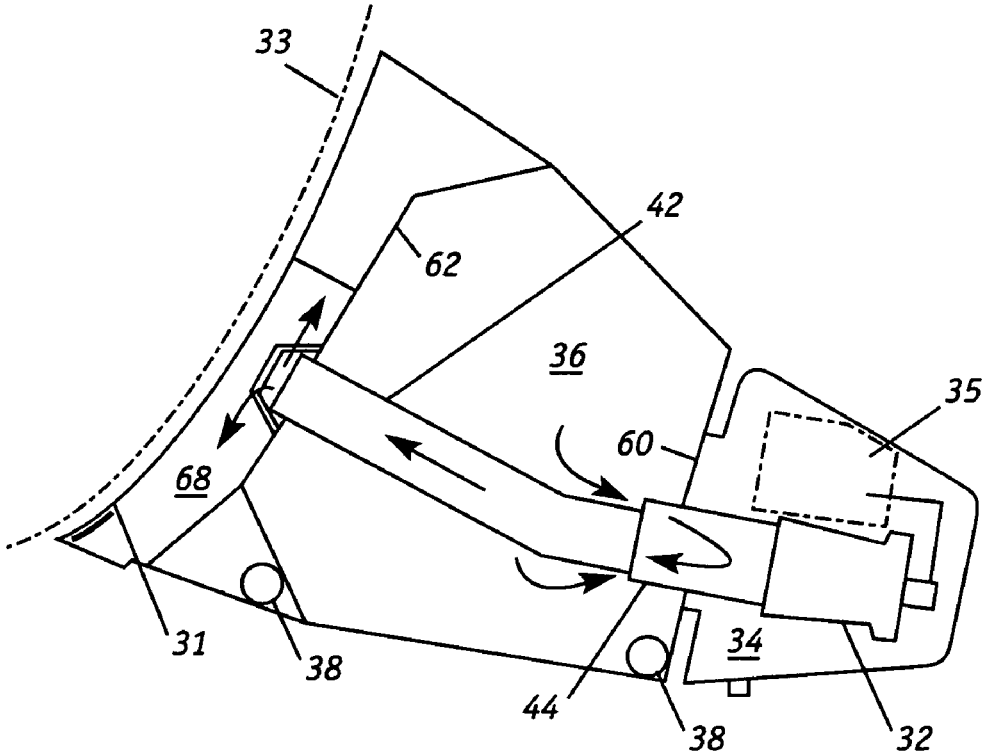
FIG. 3 is a cross sectional view of the compartment.
Figures 4A, 4B:
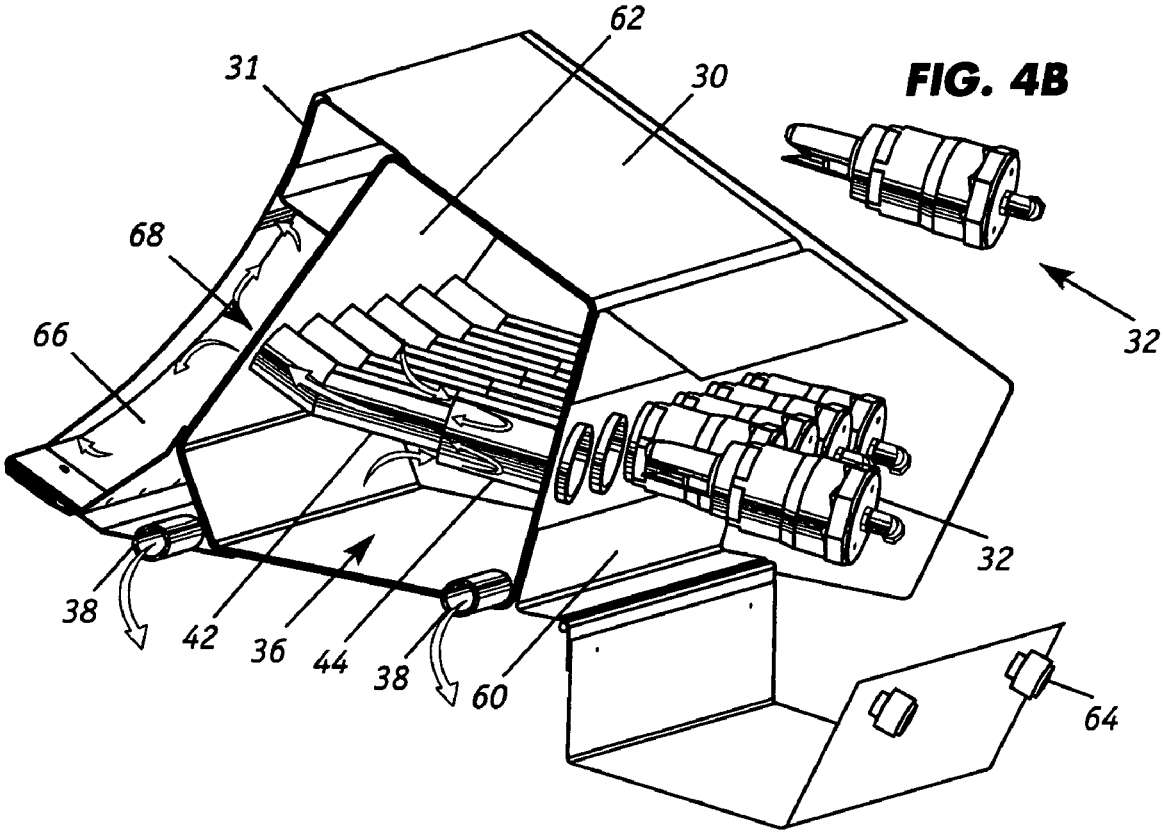
FIG. 4A is another perspective view of a compartment.
FIG. 4B illustrates an actuator.

In operation, as shown in FIGS. 3 and 4A, high pressure steam that is supplied to the header 36 is drawn into the pipe 42 through the annular opening between the pipe 42 and the sleeve 44. The amount of steam drawn is controlled by the actuator 32 which is connected to a pneumatic supply 35 which tunes or regulates the actuator by pressurizing a diaphragm that is on top of a piston that is located inside the actuator 32. The piston is connected to a measuring plug that moves inside the sleeve 44 to control the amount of steam that goes into each discharge chamber. Steam from the pipe 42 initially enters into a discharge chamber 66 through the pipe outlet 68. The high velocity steam is dispersed within the discharge chamber 66 before exiting through the perforations of the front panel screen segment 31 and contacting a continuous moving sheet 33 located in front of the perforations. By monitoring and controlling the steam flow into each of the discharge chambers, the steam profile that is injected onto the sheet along its cross direction can be continuously regulated. The steam profile as measured along the length of the steam distribution apparatus can be uniform or non-uniform so that the sheet or web of material can be exposed to a steam curtain having different amounts of steam in the cross direction.

As shown in FIG. 2, the front screen panel segment 31 has a concaved exterior contour; as is apparent, the individual perforations in the panel segment 31 are not shown. A backing bar 98 is secured to the lower end of the laterally spaced baffles 40. The front screen panel segment 31 is welded onto a portion of the backing bar 98 as well as onto the baffles 40. In this fashion, the front screen panel segment 31 forms the front perforated wall of the steam discharge chambers. The front of the backing bar 98 also defines a series of dowel pins 84 that helps align the cleanout bar 48 as it is secured with screws 50 to the body of the steam distribution apparatus as further described herein. When it is necessary to clean the steam discharge chambers between the baffles 40, it is only necessary to remove the cleaning bar 48 to gain access to the discharge chambers through access slots that are located at the lower end of each discharge chamber.

The baffles 40 and front screen panel segment 31 are preferably welded onto the body of the housing as shown in FIG. 4A. By welding the inner side of the segment 31 to the baffles 40, steam does not leak from one discharge chamber to an adjacent one. Gaskets can be employed to further reduce leakage. As is apparent, the number of front screen panel segments 31 required to cover a steam distribution apparatus will depend on the total cross directional length of the steam distribution apparatus and the cross directional length of each panel segment 31.

Figure 5:
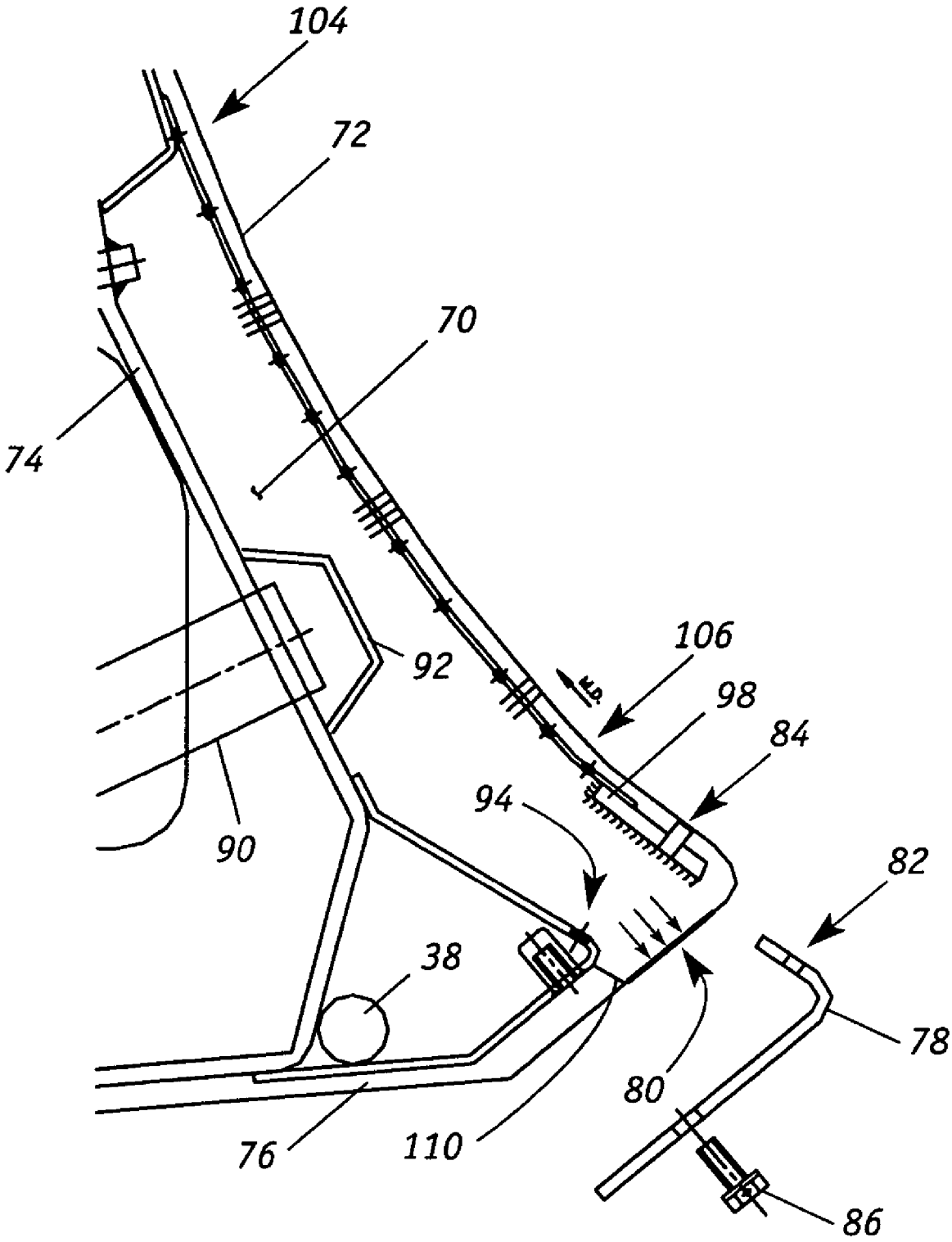
FIG. 5 is a cross sectional view of a front portion of the discharge compartment adjacent the discharge screen plate with the cleanout bar removed.

FIG. 5 shows a steam discharge chamber 70 that is covered by perforated screen plate 72 and that is welded onto the baffles (not shown) and onto body 76 of the steam distributor apparatus. In this embodiment, the perforated screen plate 72 is configured as a slightly curved two-sided panel. The discharge chamber 70 is partitioned from the header by the header exterior wall 74. The body 76 and the header exterior wall 74 both extend the entire length of the steam distribution apparatus and provide structural support for the baffles and the perforated screen plate 72. The lower end of screen plate 72 can be positioned between the projection of body 76 and a continuous backing bar 98 which provides additional support for the screen plate 72. The backing bar 98 serves as a holding plate for the cleanout bar 78.

In the lower part of the body 110 of the steam shower there is a series of fixed inserts with threaded holes. The access slot 80 can be sealed with a detachable cleanout bar 78. Each access slot 80 is typically 1.5 in. (3.8 cm) to 2 in. (5.1 cm) wide as measured in the machine direction and 3 in. (7.6 cm) to 6 in. (15.2 cm) long as measured in the cross direction. With the bar 78 removed, the discharge chamber 70 can be cleaned. As is apparent, locating the access slot 80 in the lower part 110 substantially underneath the screen plate 72 creates an unobstructed path to maneuver a spray wand into the access slot 80 for cleaning the internal parts of the discharge chamber and for cleaning the inner surface of the screen plate 72. Moreover, the debris inside the discharge chamber should accumulate near the access slot 80 for easy removal. When the steam distribution apparatus is equipped with a plurality of access slots along its length, it is necessary to removed only selected bars to gain access to certain discharge chambers that require maintenance. To insure a tight seal, a polymeric gasket can be positioned around the opening of the access slot 80. To facilitate alignment of the cleanout bar 78 over the access slot 80, the "L" shaped cleanout bar 78 can include an aperture 82 which can be visually aligned to a corresponding dowel pin 84 that is located on the bottom side of the screen plate 72. Once the aperture 82 and dowel pin 84 are aligned, the cleanout bar 78 can be fully mounted to the steam shower body 110 using bolts 86 thereby sealing the bottom portion of the control chamber 70 (shown in FIG. 6)

Figure 6:
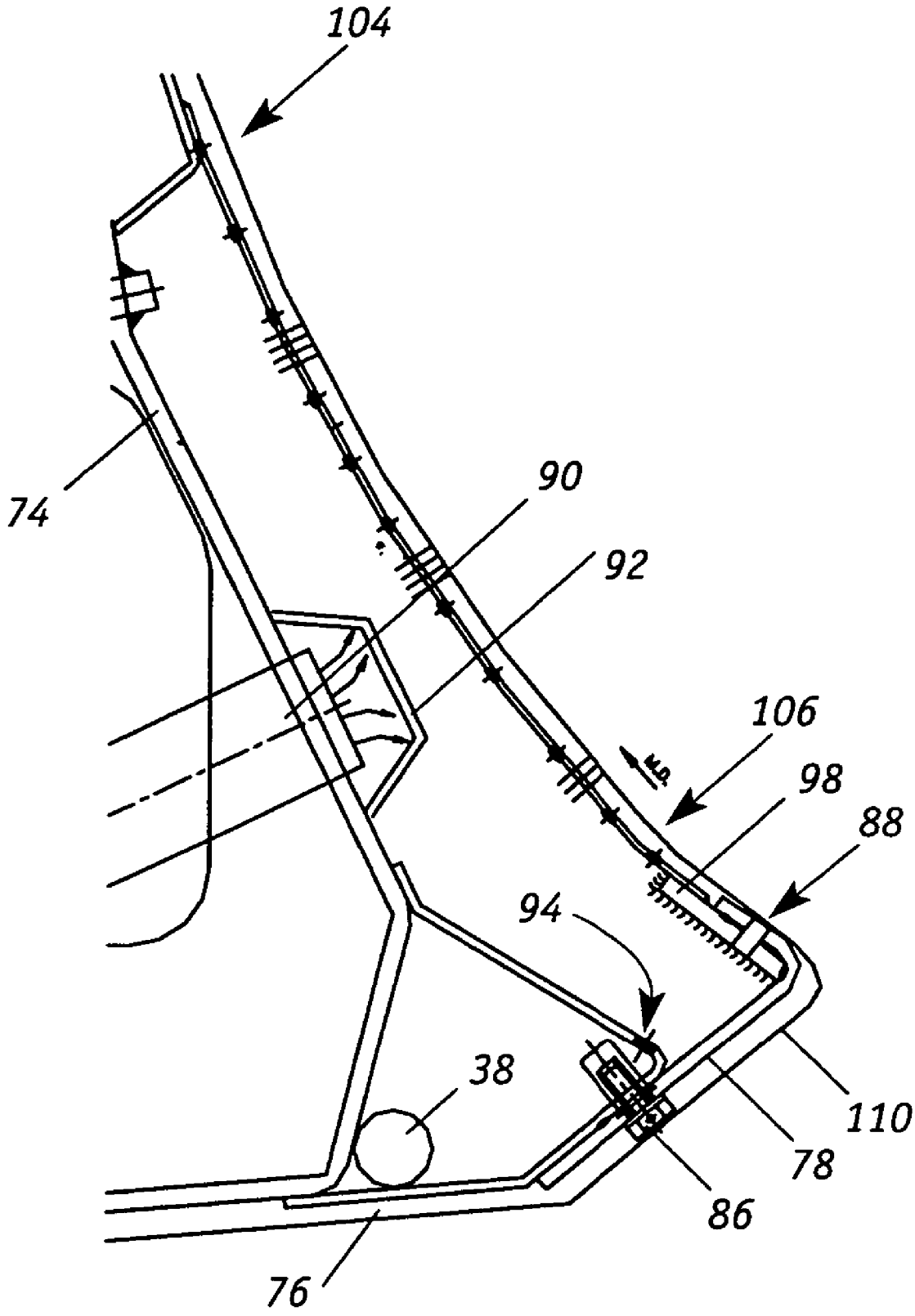
FIG. 6 is a cross sectional view of a front portion of the discharge compartment adjacent the discharge screen plate with the cleanout bar attached during normal operating conditions.

In operation, as shown in FIG. 6, the cleanout bar 78 is fastened to the lower wall 110 of the discharge chamber 70 with bolts 86. High pressure steam from the header is discharged through the nozzle of a pipe 90 and into the discharge chamber 70. Preferably, a target plate 92 which serves as a baffle, is positioned to disperse the high velocity steam uniformly throughout the discharge chamber 70 before the steam permeates through the perforations in the screen plate 72. In this fashion, there is uniform steam distribution from the leading edge 104 to the trailing edge 106 of the steam distribution apparatus as the sheet of material moves across the screen plate 72 in the machine direction (MD). Condensate that forms on the bottom of the discharge chamber 70 seeps through a drain hole 94 and out through a condensate drain 38.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. An apparatus to distribute steam to a moving sheet, the apparatus having a leading edge and a trailing edge relative to the moving sheet, the apparatus comprises:

(a) a steam distribution header; and (b) a housing comprising a plurality of partition panels that are spaced apart along the length of the apparatus to form a plurality of steam discharge chambers that are covered with a front perforated screen plate that has an exterior surface with a contour that matches that of the moving sheet, wherein each discharge chamber is in fluid communication with the steam distribution header and the at least one steam discharge chamber has a lower wall that defines a sealable access slot that is tightly covered and wherein the front perforated screen plate is welded to the plurality of partition panels so that the front perforated screen plate is permanently secured onto the plurality of partition panels.

2. The apparatus of claim 1 wherein each sealable access slot is covered with a removable bar.

3. The apparatus of claim 2 further comprising means for aligning the removable bar over the sealable access slot.

4. The apparatus of claim 3 wherein the means for aligning the removable bar comprises an aperture in the perforated screen plate and a matching opening in the removable bar.

5. The apparatus of claim 1 wherein each control chamber is connected to the steam distribution header by a conduit that has an inlet located in the steam distribution header and an outlet located in the discharge chamber.

6. The apparatus of claim 5 wherein each outlet of the conduit faces the front perforated screen plate and the apparatus further comprising a target plate in each discharge chamber that is positioned between the outlet and the front perforated screen plate such that the steam flowing from the outlet contacts the target plate so that the steam is dispersed substantially throughout the discharge chamber before the steam permeates through the perforated screen plate.

7. The apparatus of claim 1 wherein each discharge chamber has a sealable access slot that is tightly covered and that is located at a lower wall of the discharge chamber.

8. An apparatus to distribute steam to a moving sheet, the apparatus having a leading edge and a trailing edge relative to the moving sheet, the apparatus comprises:

(a) a steam distribution header;

(b) a housing comprising a plurality of partition panels that are spaced apart along the length of the apparatus to form a plurality of discharge chambers that are covered with one or more front perforated screen plates with each perforated screen plate having an exterior surface with a contour that matches that of the moving sheet, wherein each discharge chamber is in fluid communication with the steam distribution header through a conduit that has an inlet in the steam distribution header and an outlet in a discharge chamber and wherein each discharge chamber includes a lower wall that defines a sealable access slot that is tightly covered and wherein the one or more front perforated screen plates are welded to the plurality of partition panels so that the one more front perforated screens plate are permanently secured onto the plurality of partition panels; and (c) means for controlling the flow of steam from the steam distribution header to each discharge chamber.

9. The apparatus of claim 8 further comprising means for aligning the removable bar over the scalable access slot.

10. The apparatus of claim 9 wherein the means for aligning the removable bar comprises an aperture in the one or more perforated screen plate and a matching opening in the removable bar.

11. The apparatus of claim 8 wherein each discharge chamber is connected to the steam distribution header by a conduit that has an inlet located in the steam distribution header and an outlet located in the discharge chamber.

12. The apparatus of claim 11 wherein each outlet of the conduit faces a front perforated screen plate and the apparatus further comprising a target plate in each discharge chamber that is positioned between the outlet and the front perforated screen plate such that the steam flowing from the outlet contacts the target plate so that the steam is dispersed throughout the discharge chamber before the steam permeates through the perforated screen plate.

13. The apparatus of claim 8 wherein steam flow through each conduit is controlled by an actuator.

14. The apparatus of claim 8 wherein the means for controlling the flow of steam controls the flow of steam from the steam distribution header to each discharge chamber.

15. The apparatus of claim 8 wherein each perforated screen plate has a non-planar exterior surface.

* * * * *